United States Patent [19]

Fellman et al.

[11] 4,293,131

[45] Oct. 6, 1981

[54] ELECTRICAL AWARD SIGNALING MEANS FOR A PINBALL MACHINE

[76] Inventors: Marc M. Fellman, 1010 S. 67th St.; Wade S. Wright, 5648 Jones, both of Omaha, Nebr. 68106

[21] Appl. No.: 864,595

[22] Filed: Dec. 27, 1977

[51] Int. Cl.[3] ..... A63D 13/00

[52] U.S. Cl. ..... 273/121 A; 335/17; 335/151; 340/654

[58] Field of Search ..... 340/646, 654; 273/121 A, 119 A, 118 A, 120 A, 122 A, 123 A; 335/17, 151

[56] References Cited

U.S. PATENT DOCUMENTS

| | | | |
|---|---|---|---|
| Re. 20,698 | 4/1938 | Bellah | 273/121 A |
| 2,103,870 | 12/1937 | Rockola | 273/121 A |
| 2,551,023 | 5/1951 | Levitt | 273/121 A |
| 2,684,246 | 7/1954 | Soroka | 273/118 A |
| 3,028,587 | 4/1962 | Vaccaro | 340/654 |
| 3,122,731 | 2/1964 | Hutchison | 340/311 |
| 3,229,274 | 1/1966 | Riley et al. | 340/664 |
| 3,312,967 | 4/1967 | Levine | 340/654 |
| 3,383,111 | 5/1968 | Lucas | 273/121 A |
| 3,401,362 | 9/1968 | Spiroch et al. | 335/17 |
| 3,570,004 | 3/1971 | De Jong | 340/664 |
| 3,979,705 | 9/1976 | Hayden | 335/151 |
| 4,093,232 | 6/1978 | Nutting | 273/121 A |

FOREIGN PATENT DOCUMENTS

| | | | |
|---|---|---|---|
| 590749 | 4/1959 | Italy | 273/121 A |
| 6714402 | 4/1968 | Netherlands | 335/151 |

*Primary Examiner*—Richard T. Stouffer

*Attorney, Agent, or Firm*—Zarley, McKee, Thomte, Voorhees & Sease

[57] ABSTRACT

An audio and/or visual signal device is mounted on a pinball machine for signaling to the area surrounding the machine that a replay game or the like has been awarded. The signal device is connected through a relay to a source of electric power. The relay is energized by a magnetic reed switch adapted to be mounted in close association with a solenoid operated knocker within the machine so that the switch is magnetically closed when the knocker is operated.

7 Claims, 3 Drawing Figures

ELECTRICAL AWARD SIGNALING MEANS FOR A PINBALL MACHINE

BACKGROUND OF THE INVENTION

It has been a common practice in arcades and similar establishments where pinball machines are operated to award free games or free balls to a player for ringing up a predetermined number of points in a single play for example. In present machines, the awarding of the free games or balls is generally accompanied by the sound of an electronic knocker device within the machine. Unless an operator is present to call attention to the award, however, it may go unnoticed by all but the individual player being awarded.

Pinball machines are provided with various lights, bells and score tabulators, all for the purpose of creating an exciting gameboard situation during each play. By comparison, the signal produced by a knocker for indicating a free game is less noticeable and may be substantially drowned out in a room where other machines are being operated. Various lighting arrangements including a revolving red lamp known as a cherry are utilized in such establishments for creating a general atmosphere of excitement but without means for keying the operation of the lights to the awarding of a replay game by an individual machine. Furthermore, to accomplish such a connection by breaking into the circuit of an existing machine would require the services of one experienced in pinball machine circuitry.

SUMMARY OF THE INVENTION

The electrical award signaling apparatus of the present invention is adapted to be mounted on or adjacent a pinball machine and easily electrically connected to the machine without breaking into its existing circuitry. The magnetic reed switch of the invention is simply disposed within the magnetic field of a solenoid operated knocker within the machine which is operated in conjunction with the awarding of replay games or the like. The signaling apparatus is provided with an independent source of electric power connected to the relay thereof. The signaling apparatus is thus suitable both as a kit for modifying existing pinball machines and as original equipment for new pinball machines.

The awarding of free games and the like is intended both as an award for an individual player's performance and as an incentive for prospective players to attempt and achieve the same performance. It is believed that the incentive value of such awards is materially enhanced when the awards are made known to others in the vicinity of the machine. Likewise, broadcasting an individual player's award increases the enjoyment and satisfaction obtainable by playing a pinball machine so equipped.

Accordingly, it is an object of the invention to provide means for automatically electrically signaling to the area surrounding a pinball machine that a replay game or the like has been awarded.

Another object of the invention is to provide an electrical award signaling means which may be quickly and easily installed on existing pinball machines.

Another object of the invention is to provide an electrical award signaling means which may be connected to a source of electric power independently of the pinball machine.

A related object of the invention is to provide an award signaling means which may be operatively electrically connected to a pinball machine without breaking into the electrical circuitry thereof.

DESCRIPTION OF THE PREFERRED EMBODIMENT

Figure 1:
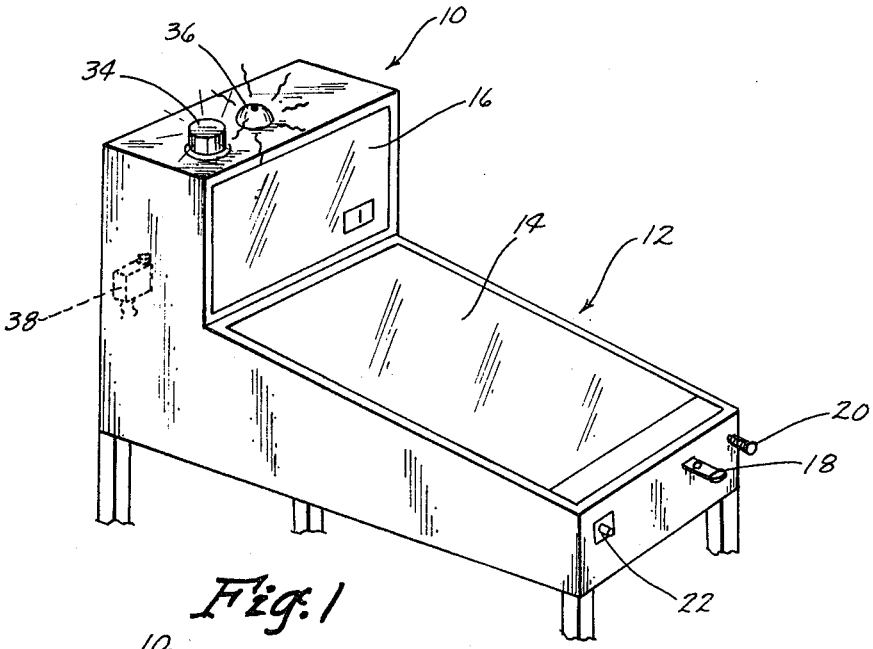
FIG. 1 is a perspective view of a pinball machine having the electrical award signaling means of the invention installed thereon.

The electrical award signaling apparatus of the present invention is indicated generally at 10 in FIG. 1 in assembly relation with a pinball machine 12. The pinball machine is of conventional construction including the usual gameboard 14, score display panel 16, coin insert 18, ball plunger 20 and control knob 22.

Figure 2:
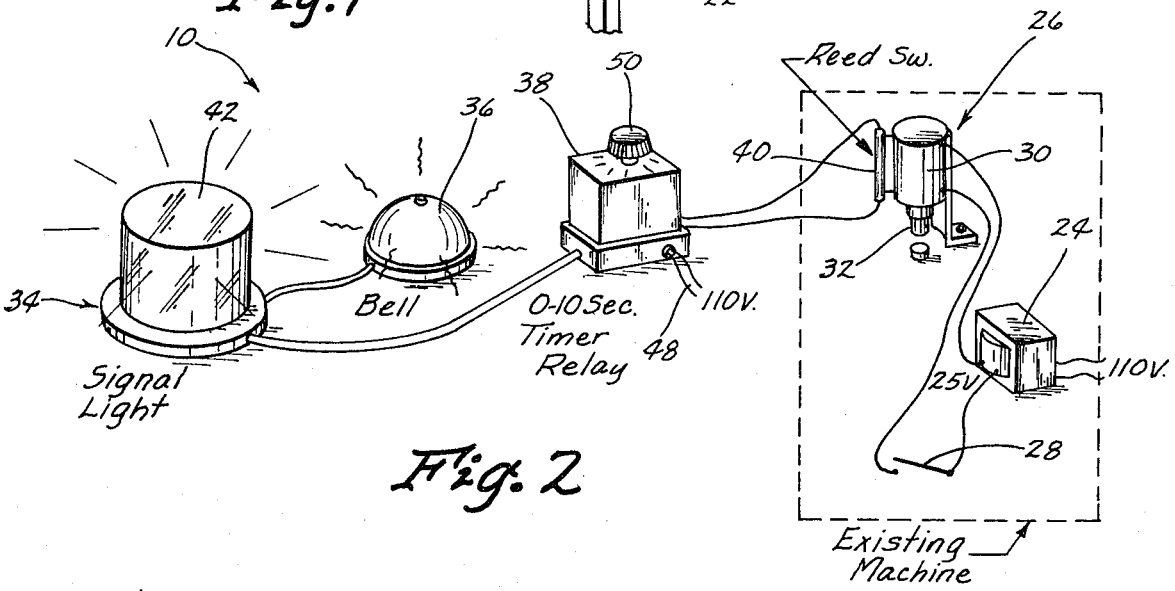
FIG. 2 is a perspective view of the invention showing the magnetic reed switch thereof disposed in close association with a knocker device within the pinball machine.

Referring to FIG. 2, there is included within the conventional circuitry of the pinball machine 12 a transformer 24 connected to a source of 110 volt electric power. Transformer 24 reduces the output voltage at the secondary coil to 25 volts for use in the electrical circuitry of the pinball machine 12. A conventional solenoid operated knocker 26 is electrically connected to the transformer 24 through a switch 28 which is automatically closed when a replay game is to be awarded. Closing of switch 28 energizes the solenoid 30 of knocker 26 causing the plunger 32 to move axially through the solenoid 30, all as is known in the art.

The electrical award signaling apparatus 10 of the present invention includes a signal light 34, as shown in FIG. 2, an electric bell 36, a timer relay 38 and a magnetic reed switch 40. Signal light 34 is a revolving lamp housed within a red bulb 42, the unit being generally referred to in the art as a cherry. Such lights are commercially available, one example being Model MV-110 made by Tripp Lite in Chicago, Ill.

Figure 3:
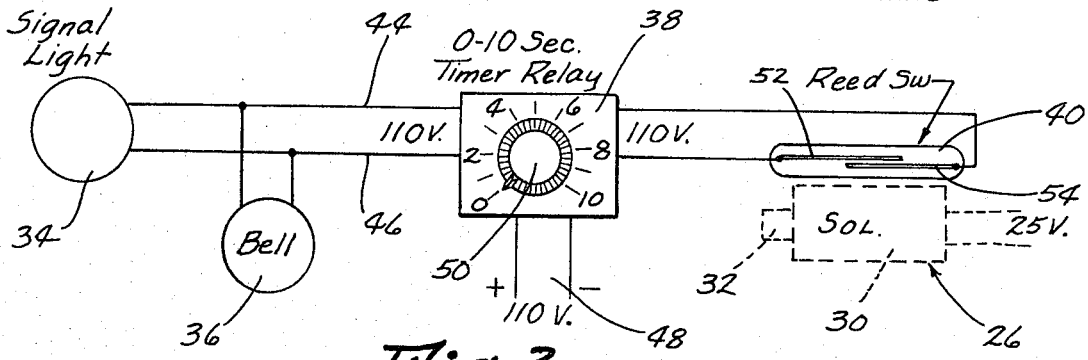
FIG. 3 is an electrical circuit diagram for the invention.

Referring to FIG. 3, it is seen that the signal light 34 and electric bell 36 are connected in parallel to output lines 44 and 46 from the timer relay 38. The relay is connected to a source of 110 volt electric power, as indicated at 48. This connection may be made within the pinball machine such as across the primary coil of the transformer 24 or the connection may be made completely independently of the pinball machine by a direct wire from the relay 38 to a conventional wall socket. A control knob 50 on the timer 38 may be adjustably rotated to a selected time setting which regulates the time period the relay remains energized each time the relay switch 40 is closed. The relay shown has an adjustable time setting of 0 to 10 seconds. The relay 38 is conventional and commercially available, such as No. 6×153 from Dayton Electric Manufacturing Company in Chicago, Ill.

The switch 40 for energizing relay 38 is provided as a magnetic reed switch, the same being commercially available such as from General Electric under the designation LX 73-50. Reed switch 40 may be mounted in close association with the solenoid 30 of knocker 26 by any suitable means such as clamps, tape or adhesives. Referring to FIG. 3, it is seen that the reed switch 40 need not be in direct contact with the solenoid 30 but must be within the magnetic field of the solenoid in order to effect contact between the overlapping reed elements 52 and 54 within the switch 40.

In operation, the signal light 34, bell 36 and timer relay 38 are mounted on the pinball machine 12 in any suitable manner, preferably at the top for maximum exposure of the signal light 34. The reed switch 40 for the relay 38 is then secured adjacent the knocker 26 within the pinball machine 12 and the relay is connected to a source of electrical power. The apparatus 10 is now set up for automatic actuation by the knocker 26 when a replay game is awarded. The operator need only adjust the timer control knob 50 to select a desired signal time for the light 34 and bell 36.

It is seen that the award signal apparatus of the present invention is thus quickly and easily installed on a pinball machine without breaking into the machine circuitry. Accordingly, the invention is suitable both as a kit for modifying existing pinball machines and for original equipment on new pinball machines. The light 34 and bell 36 produce a visual and audio signal to the area surrounding the machine 12 that a replay game, free ball or the like has been awarded. Thus, it is seen that the award signaling apparatus of the present invention accomplishes at least all of its stated objects.

We claim:

1. In combination, a pinball machine which includes an internal electrical circuit having an electronic award means including a solenoid actuated upon the accomplishment of a predetermined feat, a first electrical wire means electrically connected at one end to said internal electrical circuit and adapted for connection at the other end to a source of electric power, an award signaling circuit including a magnetic operated switch means positioned within the magnetic field of said solenoid for closing of said switch means in response to actuation of the solenoid, a relay, means operatively electrically connecting said switch means to said relay whereby the relay is energized in response to closing of said switch means, a signal means actuatable for signaling to the area surrounding the machine that an award has been won, means for operatively electrically connecting said signal means to the relay for actuating said signal means when the relay is energized, and a second electrical wire means electrically connected at one end to said award signaling circuit and adapted for connection at the other end to a source of electric power, said award signaling circuit being free of any electrical connection to said pinball machine circuit apart from said first and second electrical wire means.

2. The combination according to claim 1 wherein said signal means includes means for producing a visual signal.

3. The combination according to claim 1 wherein the signal means includes means for producing an audio signal.

4. The combination according to claim 1 wherein said signal means includes means for producing a visual signal and means for producing an audio signal.

5. The combination according to claim 1 wherein said relay includes a timer means for actuating said signal means for a predetermined length of time in response to energization of said relay.

6. The combination according to claim 1 wherein said electronic award means comprises a solenoid actuated knocker including said solenoid.

7. The combination according to claim 1 wherein said magnetically operated switch means comprises a magnetic reed switch.

* * * * *